US008760355B1

(12) United States Patent
Tonn

(10) Patent No.: US 8,760,355 B1
(45) Date of Patent: Jun. 24, 2014

(54) HYBRID DUAL BAND BUOYANT CABLE ANTENNA ELEMENT

(75) Inventor: David A. Tonn, Charlestown, RI (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 824 days.

(21) Appl. No.: 12/924,799

(22) Filed: Sep. 20, 2010

(51) Int. Cl.
*H01Q 1/34* (2006.01)

(52) U.S. Cl.
USPC ..... 343/709; 343/722; 343/719

(58) Field of Classification Search
USPC ..... 343/709, 719, 722
See application file for complete search history.

(56) References Cited

U.S. PATENT DOCUMENTS 4,774,519 A * 9/1988 Pease et al. ..... 343/709
6,426,464 B1 * 7/2002 Spellman et al. ..... 174/101.5

* cited by examiner

*Primary Examiner* — Jacob Y Choi
*Assistant Examiner* — Kyana R Robinson
(74) *Attorney, Agent, or Firm* — James M. Kasischke; Jean-Paul A. Nasser

(57) ABSTRACT

The invention as disclosed is a buoyant cable antenna configured for both VLF/LF and HF signals. A 100 foot antenna element has a low-pass filter assembly positioned at the midpoint of the antenna element to block HF signals. The outboard tip of the antenna element is shorted. In this way, the antenna element appears as a 50 foot open circuit antenna element to HF signals and as a 100 foot shorted antenna element to VLF/LF signals.

7 Claims, 2 Drawing Sheets

FIG 1
(Prior Art)
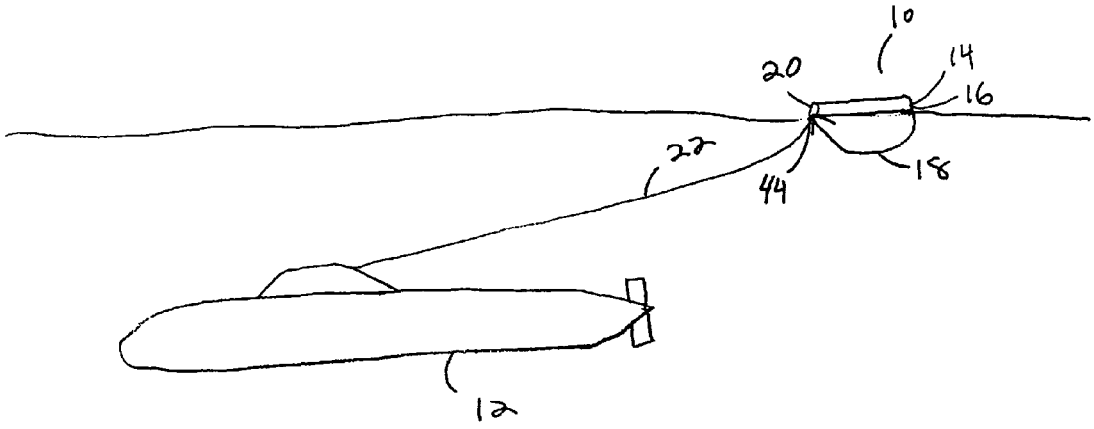
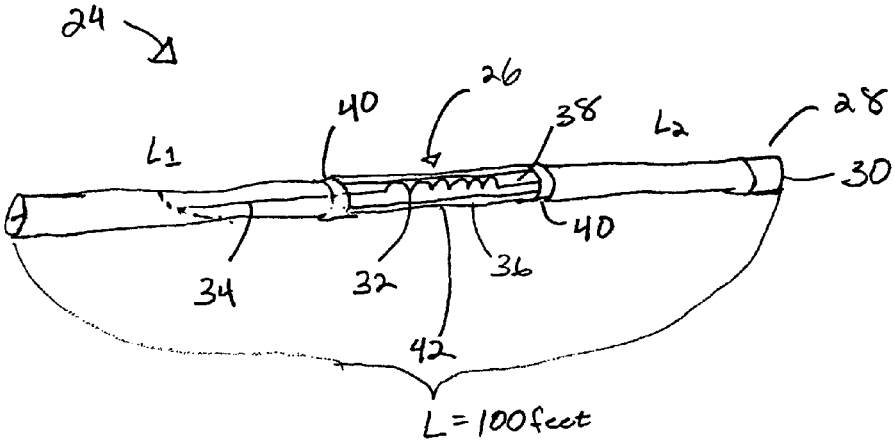
FIG 2

HYBRID DUAL BAND BUOYANT CABLE ANTENNA ELEMENT

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None.

BACKGROUND OF THE INVENTION (1) Field of the Invention

The present invention is directed to buoyant cable antennas. In particular, the present invention is directed to a new form of hybrid dual band buoyant cable antenna element suitable for underwater vehicle communication capable of providing performance suitable for very low frequency (VLF) reception and high frequency (HF) transmission and reception in a single antenna element.

(2) Description of the Prior Art

The buoyant cable antenna is one of several antennas currently in use for underwater vehicle communications. It consists of a positively buoyant insulated wire that floats on the ocean surface. It connects to the submerged underwater vehicle by means of a long length coaxial transmission line. It is used for communications primarily in the VLF through HF (10 kHz-30 MHz) frequency range. Using existing systems, VLF reception is best using a 100 ft antenna with a short circuit tip. However, HF performance is sacrificed when using this antenna. Conversely, HF performance is best achieved using a 50 ft antenna with an open circuited tip, but this configuration compromises VLF performance.

Currently, there is a need for a hybrid dual band buoyant cable antenna element suitable for underwater vehicle communication capable of providing performance for both VLF reception and HF transmission and reception in a single antenna element.

SUMMARY OF THE INVENTION

It is a general purpose and object of the present invention to provide communication for underwater vehicles through a buoyant cable antenna element.

It is a further object of the present invention to provide VLF reception and HF transmission and reception in a single buoyant cable antenna element.

The above objects are accomplished with the present invention through the use of a buoyant cable antenna configured for both VLF/LF and HF signals. The antenna of the present invention is a 100 foot antenna element with a low-pass filter assembly positioned at the midpoint of the antenna element to block HF signals. The outboard tip of the antenna element is shorted. In this way, the antenna element functions as a 50 foot open circuit antenna element to HF signals and as a 100 foot shorted antenna element to VLF/LF signals.

BRIEF DESCRIPTION OF THE DRAWINGS

A more complete understanding of the invention and many of the attendant advantages thereto will be more readily appreciated by referring to the following detailed description when considered in conjunction with the accompanying drawings, wherein like reference numerals refer to like parts and wherein:

FIG. 1 illustrates prior art buoyant cable antennas;

FIG. 2 illustrates the antenna of the present invention with a cut-away view of the internal low pass filter mechanism.

DETAILED DESCRIPTION OF THE INVENTION

Figure 3:
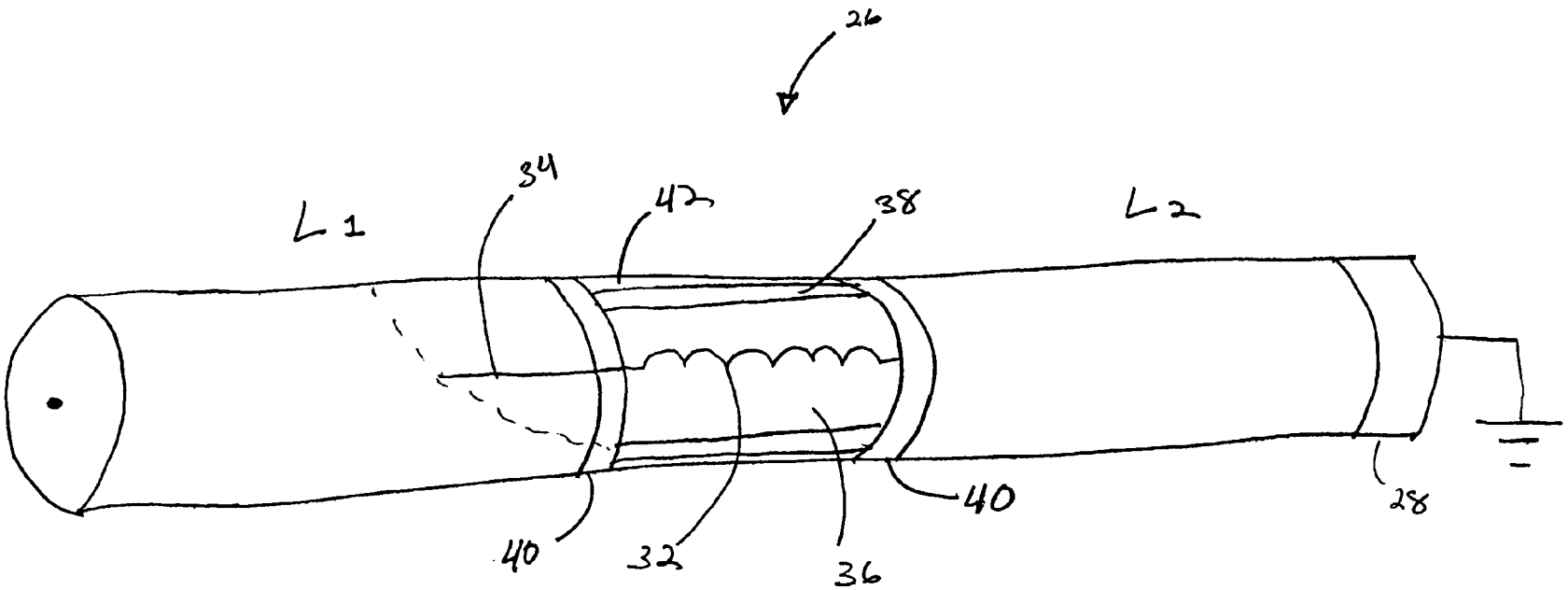
FIG. 3 illustrates the details of the low pass filter and antenna segments of the present invention.

Referring to FIG. 1, there is illustrated a prior art buoyant cable antenna 10 consisting of a positively buoyant insulating jacket that surrounds an electrically conductive wire such that the insulated wire floats on the ocean's surface. Buoyant cable antennas 10 have the ability to allow an underwater vehicle 12 to engage in radio communication while the underwater vehicle 12 is operating and submerged. Although it is in principle possible to use this antenna 10 in the VHF band (up to 300 MHz) most of its usefulness comes in the VLF through HF bands, from 10 kHz through 30 MHz.

AT VLF and LF (10 kHz-300 kHz) any practical antenna will be electrically short, that is, much shorter than a wavelength. Current buoyant cable antenna systems use a 100 foot long antenna 10 with a short circuit termination 14 on the outboard tip 16. The short circuit termination 14 allows radio frequency (RF) current to flow into the ocean off the outboard tip 16 of the antenna 10 and forms a "return loop" 18 through the water back to the grounding point 20 for the antenna 10. The grounding point 20 on current buoyant cable antennas 10 is the coupling 44 between the antenna 10 and the coaxial transmission 22 line that connects it to the underwater vehicle 12. The return loop 18 is made possible by the low frequency of operation. At low frequencies, the skin depth in seawater is sufficiently deep enough to allow a modest return loop 18 to be formed under the antenna 10 as illustrated in FIG. 1. The presence of this return loop 18 increases the gain of the antenna 10 at VLF and LF. However, it hurts the gain at HF due to the increased ohmic losses that are induced in the ocean.

Due to the increased ohmic losses that are induced in the ocean, underwater vehicles 12 seeking electronic communication at the HF band require a separate 50 foot buoyant cable antenna with an open circuited termination. The 50 foot HF antenna has a gain that is superior to the 100 ft short circuited antenna at high frequency, but has a poor VLF performance because the open circuit termination prevents the formation of a return loop 18 of current under the antenna such as the one depicted in FIG. 1.

Referring to FIG. 2 there is illustrated the buoyant cable antenna element 24 of the present invention, similar in design to the prior art buoyant cable antenna element 10, that functions by introducing a low-pass filter assembly 26 half way along the length L of the antenna element 24. In a preferred embodiment, the antenna element 24 length L is 100 feet. Antenna element 24 has a short circuit termination 28 at the outboard tip 30. The purpose of the low-pass filter assembly 26 is to block transmission and reception of signals in the HF band at the midpoint of the antenna. Blocking the transmission and reception of signals in the HF band confines the signals to the first half $L_1$ of the antenna element 24, while allowing VLF and LF signals to pass through the length of the second half, $L_2$, to the outboard tip 30 of the antenna element 24. In this way, the antenna element 24 functions like a 50 ft open circuited antenna at HF, while also functioning as a 100 ft short circuited antenna at VLF and LF.

In a preferred embodiment, the low-pass filter assembly 26 consists of a single high-frequency shielded inductor 32 electrically connected in series with the wire 34 in the antenna element 24 as illustrated in FIG. 3. Other embodiments of the low-pass filter 26 are a pi-type or t-type filter. The inductor 32 should have an inductive reactance that is low at VLF allowing current to flow the entire length of the antenna element 24. At HF, the inductive reactance is expected to be high compared to the impedance of the buoyant cable antenna 24 and will block current flow, restricting the current to the first half $L_1$, which is the shorter section of the antenna element 24. Depending upon the specific embodiment, the low-pass filter assembly 26 is placed inside a chassis 36 and a housing 38 to give it mechanical strength and to facilitate its series connection with the wire 34 of antenna element 24.

The method of manufacturing the antenna element 24 of the present invention requires the following steps. The antenna element 24 is cut halfway along its length L and fitted with watertight connectors 40 in order to then connect the low-pass filter assembly 26 into the antenna element 24 in series. The filter assembly 26 is placed inside a chassis 36 and a housing 38 to give it mechanical strength and to facilitate its series connection with the wire 34 of antenna element 24 and then is connected to the watertight connectors 40. The filter assembly 26 is then encased in a watertight tube 42 to protect it from seawater corrosion and to give it mechanical strength to withstand being towed through the water.

It is assumed that the HF section shall be the same 50 foot long section as the baseline prior art buoyant cable antenna system. To maintain the same VLF reception capability that is currently available from existing prior art buoyant cable antennas, an overall antenna length L of 100 feet with a short circuit termination is considered, but with a low pass filter connected in series placed half-way along the length of the buoyant cable antenna to produce a 50 foot long HF section.

The characteristic impedance of existing buoyant cable antennas 10 is approximately 180-j11Ω at the high end of the MF band/low end of the HF band. The series inductor 32 makes an approximate series single-pole R-L circuit with the second section $L_2$ of the buoyant cable antenna 24. The pole frequency of a series R-L circuit can easily be shown to be:

$$f_p = \frac{R}{2\pi L} \tag{1}$$

To set the pole in the middle of the MF band, at 600 kHz, an inductor whose value is approximately 50 pH is needed. The HF gain of the hybrid antenna element 24 of the present invention with a 50 pH inductor is very comparable to that of the prior art unloaded 50 foot long open-circuited antenna. There is a slight loss in gain below 8 MHz caused by the introduction of the inductor 32. The inductor's reactance is shifting the resonance of the antenna 24 slightly and introducing a small offset between the two gain curves.

At VLF/LF, the gains are nearly identical below 50 kHz, though the antenna 24 of the present invention does begin to exhibit a weaker gain compared with the 100 ft short-circuited one as the frequency increases toward 300 kHz and the top of the band, where the gain of the antenna 24 is down by approximately 5 dB compared with the standard 100 ft long buoyant cable antenna 10. This is largely due to the choice of pole frequency; 600 kHz is only one octave away from the top of the VLF/LF band and this is not enough of a spacing to prevent the effect of the pole from being seen. This is a consequence of a simple single-pole circuit assumed for testing purposes.

Shifting the pole upward reduces the peak drop in gain at VLF/LF to 4 dB, but increases the loss in gain at HF below 8 MHz. This is the tradeoff that exists with this approach. A compromise must be decided on between the HF performance below 8 MHz and VLF/LF performance above 50 kHz.

The above analysis shows that the introduction of a series inductor 32 into a buoyant cable antenna 24 can allow a single antenna element to operate at both VLF and HF with comparable performance to existing prior art antenna elements. The use of a single-pole network, though, does bring some compromise in the performance at the high end of the VLF/LF band and again at the low end of the HF band. It is recommended that the gain at VLF be given a lower priority than the gain at HF. This is due to the fact that very often the buoyant cable antenna operating at VLF/LF is operating in a region where the overall receive system is atmospherically noise limited. Under these circumstances, a decrease in the antenna gain will have little to no impact on overall system signal-to-noise ratio and data rate received inboard.

The advantage of the present invention is that it allows an underwater vehicle to simultaneously communicate at VLF and at HF with VLF performance comparable to that of the existing 100 ft short circuit antenna and HF performance is comparable to the existing 50 ft open circuited antenna. This capability is provided in one single antenna and so eliminates the need to switch antenna elements in order to switch from VLF reception to HF communications, or vice versa.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

What is claimed is:

1. A hybrid dual band buoyant cable antenna element comprising:

an antenna element comprising a wire surrounded by a buoyant insulating jacket, wherein the antenna element has a first end and a second end, the first end being joined to a coaxial transmission line at a grounding point and the second end consisting of an outboard tip;

a low-pass filter assembly, having a first end and a second end, that is integrated into a midpoint of the antenna element to block transmission and reception of high frequency signals in half of the antenna element while allowing very low frequency and low frequency signals to pass through the entire antenna element; and a short circuit termination joined to the outboard tip of the antenna element such that the antenna element appears as an open circuit antenna element to high frequency signals and as a shorted antenna element to very low frequency and low frequency signals.

2. The apparatus of claim 1 wherein the antenna element is 100 feet long.

3. The apparatus of claim 1 wherein the low pass filter assembly contains a single high frequency shielded inductor that is electrically connected in series to the wire of the antenna element, said inductor having an inductive reactance that is low enough at very low frequency (VLF) reception to allow current to flow through the entire length of the antenna element and high enough compared to the impedance of the antenna element to restrict current flow to half of the antenna element at high frequency (HF) transmission and reception.

4. The apparatus of claim 3 wherein the low pass filter assembly further comprises:

a chassis that contains the single high frequency shielded inductor;

a housing surrounding the chassis to give the low pass filter assembly mechanical strength; and a watertight tube surrounding the housing to protect the low pass filter assembly from seawater corrosion and to give it mechanical strength to withstand being towed through the water.

5. The apparatus of claim 4 wherein the low pass filter assembly is integrated into the antenna element through a first and a second water tight connector, wherein the first water tight connector is joined to the first end of the low pass filter assembly and connects a first half of the antenna element to the first end of the low pass filter assembly, wherein the second water tight connector is joined to the second end of the low pass filter assembly and connects a second half of the antenna element to the second end of the low pass filter assembly.

6. The apparatus of claim 1 wherein the low pass filter assembly contains a pi-type filter.

7. The apparatus of claim 1 wherein the low pass filter assembly contains a t-type filter.

* * * * *